US005357576A

United States Patent [19]

Arndt

[11] Patent Number: 5,357,576

[45] Date of Patent: Oct. 18, 1994

[54] IN THE CANAL HEARING AID WITH PROTRUDING SHELL PORTION

[75] Inventor: Horst Arndt, Kitchener, Canada

[73] Assignee: Unitron Industries Ltd., Kitchener, Canada

[21] Appl. No.: 112,278

[22] Filed: Aug. 27, 1993

[51] Int. Cl.[5] ..... H04R 25/00

[52] U.S. Cl. ..... 381/68.6; 381/68; 381/69; 381/69.2

[58] Field of Search ..... 381/68.6, 68, 69, 151, 381/69.2; 181/135

[56] References Cited

U.S. PATENT DOCUMENTS

| | | | |
|---|---|---|---|
| 4,539,440 | 9/1985 | Sciarra | 381/68.6 |
| 5,003,608 | 3/1991 | Carlson | 381/68.6 |
| 5,048,090 | 9/1991 | Geers | 381/68 |

*Primary Examiner*—Curtis Kuntz
*Assistant Examiner*—Sinh Tran
*Attorney, Agent, or Firm*—Bereskin & Parr

[57] ABSTRACT

An in-the-canal hearing aid has a shell having an inner end to be positioned in the canal adjacent the user's eardrum, and a faceplate located outwardly of the inner end but still adapted to be recessed within the ear canal in use. A protruding portion of the shell extends outwardly past the faceplate into the concha bowl and serves the dual purpose of both anchoring the hearing aid in the ear so that it cannot work its way down the ear canal, and providing a grip to facilitate insertion and removal of the hearing aid. The protruding portion is preferably cut back close to the faceplate at one side of the faceplate to facilitate battery insertion and removal, and may contain an aperture or a hook-like portion to facilitate gripping. A vent to vent the hearing aid may extend outwardly on the protruding portion to a position adjacent the rim of the protruding portion, to space the outer vent opening away from the microphone opening on the faceplate, to reduce the likelihood of feedback.

11 Claims, 3 Drawing Sheets

IN THE CANAL HEARING AID WITH PROTRUDING SHELL PORTION

FIELD OF THE INVENTION

This invention relates to a hearing aid. More particularly it relates to a hearing aid of the kind which can be inserted deeply into the ear canal.

BACKGROUND OF THE INVENTION

The desire to minimize the visibility of hearing aids in use has prompted improvements in technology used in their manufacture. For some time, it has been possible routinely to provide amplification efficiently packaged in concha or canal instruments.

It is also possible to build hearing aids which do not require a volume control to adjust loudness, because compression circuits can be used to adjust the output of the hearing aid amplifier below the uncomfortable loudness threshold of the user. Some amplifiers are able to amplify only quiet sounds, and can pass loud sounds (above a predetermined input level) through the instrument unamplified. These types of amplifiers avoid acoustic stress caused by over-amplification and eliminate the need for a volume control. Similar performance can be achieved with a well-adjusted linear amplifier which limits the maximum output sound pressure level below the discomfort level of the patient.

Therefore, once the hearing aid is placed in the ear, it no longer needs to be accessible to the user for frequent adjustments. The hearing aid can therefore be inserted quite deeply into the ear canal. Wearers of this kind of hearing aid benefit in various ways from a deep canal fitting.

One benefit is improved cosmetics. The deeper the hearing aid is seated in the canal, the less visible it becomes. At the extreme, it becomes invisible from outside the ear. However the hearing impaired person must have sufficient dexterity to insert and extract the instrument from the ear, and means must be provided as part of the hearing aid to make these operations routinely possible.

A second benefit is increased gain and power. The further the instrument is seated down the ear canal, the smaller is the residual volume between the sound outlet of the instrument and the eardrum. The smaller this volume becomes, the greater is the sound pressure level produced by the instrument. Therefore, for a given real ear output and gain, less output power is needed, and thus a smaller output transducer can be used. Both cosmetics and power consumption benefit from this effect.

A third benefit realized from seating the top of the instrument further down the ear canal is that the pinna and outer section of the ear canal are no longer occluded by the hearing aid. The unoccluded pinna and outer section of the ear canal are therefore able to function in their normal fashion, to provide directionality and frequency cues which assist the user in localizing the source of sound.

While the advantages offered by a "completely in the canal" (CIC) hearing aid are significant, there are also certain problems. With other types of hearing aids the portion of the shell which protrudes into the concha area determines and controls the insertion depth of the hearing aid into the ear canal and therefore also controls the distance, and thus the residual volume, between the inner end of the instrument and the tympanic membrane. Thus, every time the user inserts the hearing aid, he or she will be able to achieve the same insertion depth and hence the same residual volume. Because the hearing aid's output transducer always delivers its sound into the same volume, the prescribed acoustic levels produced by the instrument are always the same.

The above mentioned consistency is not always the case with CIC hearing aids. These are dependent on the first and possibly the second bend in the ear canal to locate and retain the instrument in the canal. Canals with pronounced bends can usually perform this function adequately. Canals with weak bends, or no bends at all, will not provide stable, repeatable or consistent positioning of the instrument in the canal. As a result, the perceived output power of the instrument will vary widely, in many cases seriously affecting user satisfaction.

A further problem is that it has been normal in the past to provide a short length of nylon or fishing line to assist in removing the CIC instrument from the ear canal. Such piece of line is attached to the faceplate of the hearing aid and protrudes a short distance into the concha when the hearing aid is properly located in the ear canal. To remove the hearing aid, the line is grasped and the hearing aid is pulled out. However if the canal bends do not retain the instrument securely, the instrument may work its way down the canal sufficiently far that the line disappears into the canal and is no longer accessible. In addition users may not wish to have a piece of line protruding from their ears.

BRIEF SUMMARY OF THE INVENTION

It is therefore an object of this invention to provide a new construction for CIC hearing aids which reduces the problems referred to above, and which can also provide additional advantages.

In one of its aspects the invention provides a hearing aid comprising:

(a) a shell adapted to be inserted into the ear canal of a user, (b) sound receiving and amplification means in said shell, including a microphone for receiving sound, an amplifier for producing an amplified signal, and an output transducer for producing amplified sound, (c) said shell having an inner end having an opening therein for delivery of amplified sound from said output transducer to the user's tympanic membrane, and having a faceplate located outwardly from said inner end, (d) said shell having a protruding portion extending outwardly past said faceplate, said protruding portion being shaped to extend into the concha area of the user's ear when the shell is inserted into the user's ear canal with the inner end of said shell adjacent the user's tympanic membrane and with said faceplate recessed within the user's ear canal, (e) said protruding portion being shaped to anchor said shell and prevent it from moving into the ear canal and also constituting a grip for insertion and removal of said hearing aid.

Further objects and advantages of the invention will appear from the following description, taken together with the accompanying drawings.

DETAILED DESCRIPTION OF PREFERRED EMBODIMENT

Figure 1:
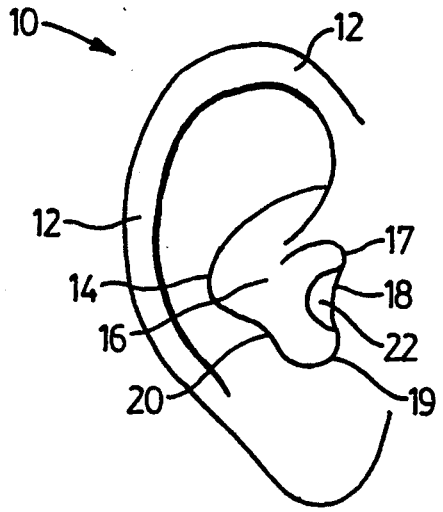
FIG. 1 is a view of a standard ear labelled to illustrate the terminology used.

Reference is first made to FIG. 1, which shows a normal ear with certain parts indicated by the following reference numerals and with the name of the part shown in parentheses beside the reference numeral. FIG. 1 is presented for convenience in understanding the terminology which will be used in this application.

| NAME OF PART OF THE EAR | REFERENCE NUMERAL |
|---|---|
| Pinna (the external or outer part of the ear) | 10 |
| Helix | 12 |
| Anti-helix | 14 |
| Concha (the hollow portion into which the ear canal opens) | 16 |
| Anterior notch | 17 |
| Tragus | 18 |
| Intertragal notch | 19 |
| Anti-tragus | 20 |
| Ear canal | 22 |

Figure 2:
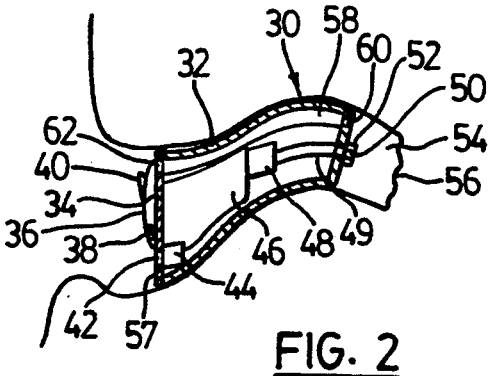
FIG. 2 (PRIOR ART)
FIG. 2 is a sectional view showing a conventional CIC hearing aid located completely in an ear canal.

Reference is next made to FIG. 2, which shows a conventional CIC hearing aid 30 located fully in the ear canal 22. The hearing aid 30 includes a shell 32 which terminates at a faceplate 34 at the outer end of the hearing aid. The faceplate 34 includes a swing-out battery compartment 36 to receive a battery (not shown). The compartment 36 is hinged at 38 to swing outwardly when a hooked portion 40 of the compartment is grasped, for battery replacement.

The faceplate 34 also includes a microphone opening 42 communicating with a microphone 44. An amplifier 46 connected to the microphone amplifies the sound signal produced by the microphone and directs the amplified signal to an output transducer 48. The output transducer 48 communicates via tube 49 with an output opening 50 located at the inner end 52 of the instrument. The output opening 50 directs sound from the output transducer into a volume 54 between the inner end 52 of the instrument and the user's tympanic membrane diagrammatically indicated at 56. A length of nylon line 57 attached to the faceplate 34 extends into the concha 16 to assist in removal of the hearing aid. A trimmer control (not shown in FIG. 2 but shown at 59 in FIG. 3) on the faceplate adjusts the amplifier characteristics.

The hearing aid 30 is vented (to equalize the pressure between the volume 54 and the exterior) in conventional manner. A vent tube 58 extends from an opening 60 at the inner end of the shell 32, along the inside wall of the shell to an opening 62 in the faceplate 34. A typical such vent arrangement is shown in U.S. Pat. No. 5,084,224 issued Jan. 28, 1992, assigned to the assignee of the present invention.

Figure 3:
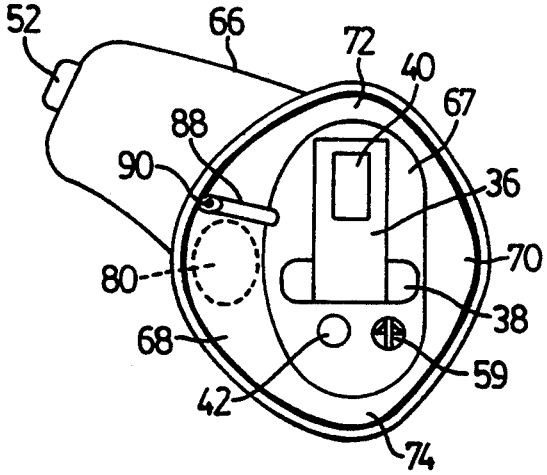
FIG. 3 is a perspective view of a hearing aid according to the invention.
Figure 4:
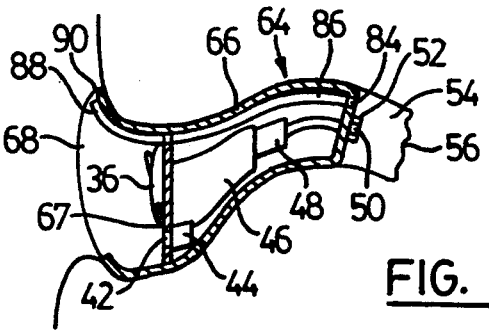
FIG. 4 is a sectional view of the FIG. 3 hearing aid located in an ear canal.

Reference is next made to FIGS. 3 and 4, which show an in-the-canal hearing aid 64 according to the invention. In FIGS. 3 and 4 corresponding reference numerals indicate parts corresponding to those of FIG. 2. The hearing aid 64 includes a shell 66 which is the same as shell 32 except as will be described. The hearing aid 64 contains the same battery compartment 36, microphone 44, amplifier 46, and output transducer 48, and the same openings 42, 50, as the hearing aid 30.

However the hearing aid 64 differs from prior art CIC hearing aids in that in hearing aid 64, the shell 66 protrudes or flares outwardly past the faceplate 67 into the concha 16. The protruding portions of the shell are indicated at 68, 70 in FIGS. 3 and 4. As shown, the shell 66 protrudes to its greatest extent in the concha and tragus areas and is cut back to a level close to (but still outwardly of) the faceplate at the upper and lower ends of the faceplate, as indicated at 72, 74.

The flared portions 68, 70 of the shell 66 perform two functions. Firstly, they anchor the hearing aid 64 consistently and safely in the canal 22 during insertion, so that the volume 54 between the inner end 52 of the hearing aid and the tympanic membrane 56 is always consistent. Secondly, they permit easy removal of the hearing aid 64 from the canal, simply by grasping one of the flared portions 68, 70. In addition the flared portions 68, 70 still leave much of the pinna unoccluded, thereby helping the user to retain some of the directionality and frequency cues needed for localization of a sound source. The need for a nylon line is also eliminated.

The shell flare can be constructed in various ways to anchor the hearing aid safely and consistently and to facilitate removal. Some of those ways are shown in the following drawings, in which corresponding reference numerals with an alphabetic suffix indicate parts corresponding to those of FIGS. 2 to 4.

Figure 5:
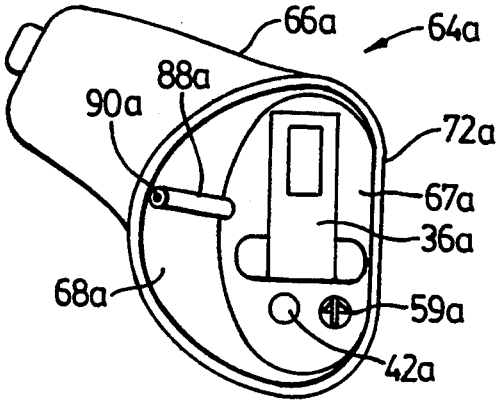
FIG. 5 is a perspective view of a modification of the FIGS. 3 and 4 hearing aid.
Figure 6:
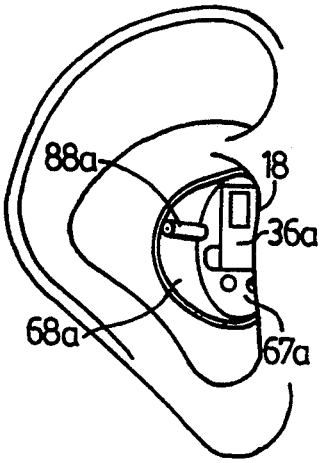
FIG. 6 is a perspective view of the hearing aid of FIG. 5 inserted into an ear.

As shown in FIGS. 5 and 6, the shell flare extends at **68*a* into the concha bowl 16 on the side opposite to the tragus 18, and the flare is cut down at 72*a* to the level of the faceplate in the tragus area. FIG. 6 shows the hearing aid 64*a* having this feature and located in a user's ear. Preferably the shell 66*a*, or at least the flared portion 68*a*** of the shell, is made of a skin coloured material or of a transparent material to minimize its visibility.

Figure 7:
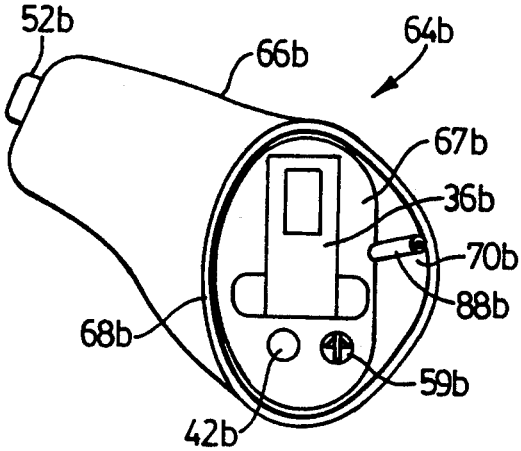
FIG. 7 is a perspective view of a further modified hearing aid according to the invention.

Reference is next made to FIG. 7, which shows an arrangement opposite to that of FIG. 6. As shown in FIG. 7, the portion **70*b* of the shell is flared outwardly but elsewhere, e.g. at 68*b*, the shell is recessed back to approximately the level of the faceplate 67*b***. This arrangement, as well as that shown in FIGS. 5 and 6, facilitates opening the battery compartment and removing the battery.

Figure 8:
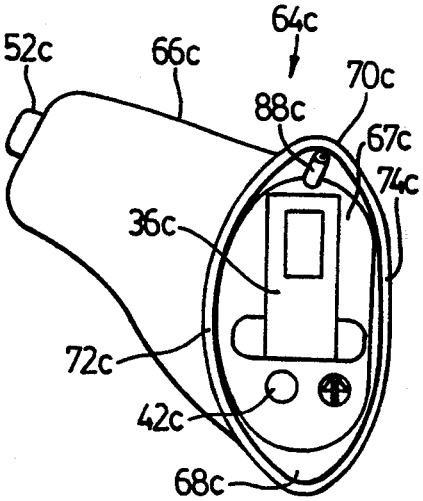
FIG. 8 is a perspective view of another modified hearing aid according to the invention.

FIG. 8 shows another modification in which the shell **66*c* is contoured to have a portion 68*c* which flares or extends outwardly beyond the faceplate 67*c* in the intertragal notch 19 area, with a corresponding extending portion 70c in the anterior notch 17 area. These are the shorter sides of the faceplate (which is normally oval in shape). On the longer sides of the faceplate, the shell is recessed back to approximately the level of the faceplate, as indicated at 72c, 74c**.

Figure 9:
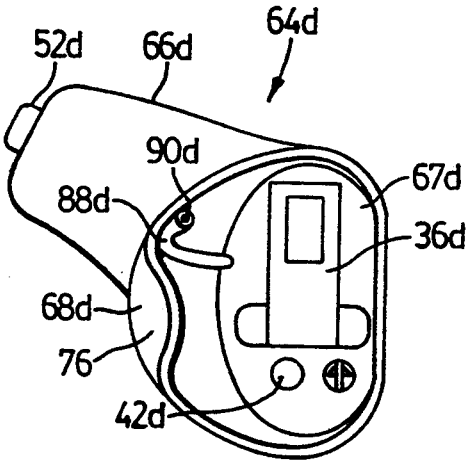
FIG. 9 is a perspective view of a further modified hearing aid according to the invention.
Figure 10:
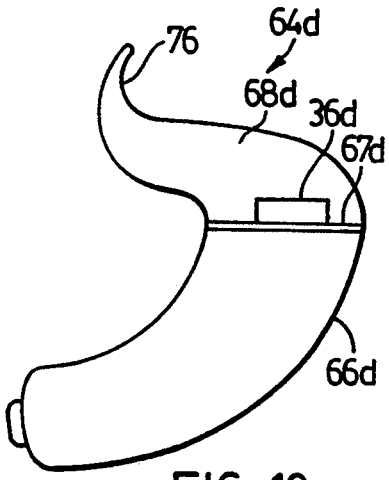
FIG. 10 is a side view of the hearing aid of FIG. 9.

If desired, the extended or flared portions of the shell described above can be configured so that they curve into the concha, as shown in FIGS. 9 and 10. The FIGS. 9 and 10 hearing aid 64d is similar to the hearing aid 64a of FIG. 5 except that the flared portion 68d in FIGS. 9, 10 curves into the concha to form a hook-like portion 76. The hook-like portion 76 facilitates gripping for removal from the ear. It will be appreciated that the hook-like formation can be made very small and displaced only a short distance from the inner surface of the concha bowl, so that its visibility is low. Conversely, it can be made as large as necessary to satisfy an individual's need.

Figure 11:
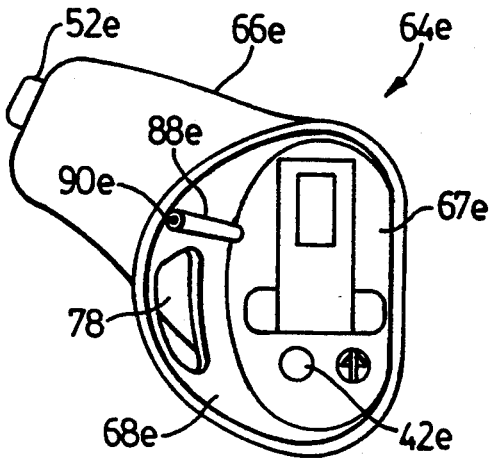
FIG. 11 is a perspective view of another modified hearing aid according to the invention.
Figure 12:
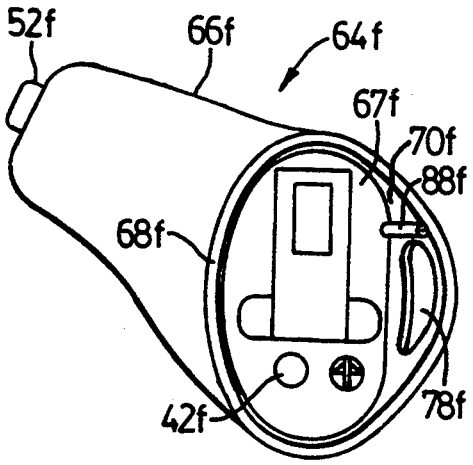
FIG. 12 is a perspective view of a modification of the hearing aid of FIG. 11.

Another way to make the flared portion more grippable is shown in FIG. 11. The FIG. 11 hearing aid 64e is the same as that of FIG. 5 except that the extended portion 68e contains a small opening 78 near its outer end or rim, to facilitate gripping. The FIG. 12 version corresponds to the FIG. 7 version except that again the extended portion 70f of the shell contains a small opening 78f to facilitate gripping.

Figure 13:
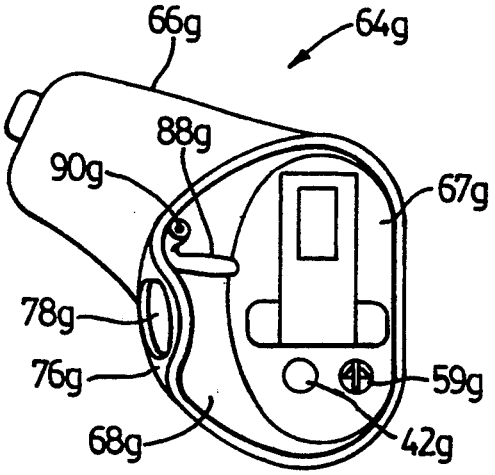
FIG. 13 is a perspective view of a still further modified hearing aid according to the invention.

An embodiment which combines the features of the FIGS. 9 and 10 version and the FIG. 11 version is shown in FIG. 13. In the FIG. 13 version the portion 68g of the shell 66g is extended outwardly and formed into a hook-like portion 76g constituted in part by the bend at 76g, and in addition the extended portion 68g of the shell includes an opening 78g near its outer end (in the hook-like portion) to facilitate gripping.

The flare contours described above provide different areas of the flare to be used to anchor the instrument repeatably in the ear and to assist in removal of the instrument from the ear. One or other of these versions may be best suited to an individual patient, depending on the configuration of the patient's ear, and may be chosen on an individual basis for the patient to achieve the best combination of function and cosmetic attractiveness.

The versions .which do not have the hook-like configuration can be produced by taking a standard ear canal impression and then producing a shell fabricated from that impression. The impression normally includes a part which duplicates the interior of the concha bowl adjacent the canal, and that part can be used to produce the flared or extended portion(s) of the shell. The versions having the hook-like portion 76, 76g require the canal impression to be modified (by appropriate sculpturing) to provide an accentuated curvature into the concha volume for desired areas of the flare, to provide improved grip for removal purposes.

Since in all cases the faceplate 67 is recessed into the canal portion of the hearing aid, and the entire hearing aid except for the protruding part of the shell is located entirely in the canal, the cosmetic appeal of a hearing aid built according to the invention is largely maintained.

Once the shell is made according to the canal impression, the faceplate 67 is shaped to conform to the contour of the canal opening so that the faceplate will seat into the shell at the proper location. This can be achieved by transferring the contour of the preferred location in the canal shell to the faceplate by any conventional means and then milling or grinding the faceplate shape accordingly. The contoured faceplate 67 is then prepared with microphone and trimmer openings; the microphone 44 and trimmer 59 are attached, and the amplifier 46 and output transducer 48 are assembled onto the faceplate 67. The faceplate 67 with the components attached is then placed in the shell 66 and located properly, and glue is then applied around the periphery of the faceplate. The glue permanently secures the faceplate 67 in position and seals it acoustically.

It will be appreciated that the battery compartment will typically be one of two conventional designs. One conventional design, as illustrated, is the swing-out door or compartment 36 which holds the battery. The other conventional design (not shown) is a flat low profile hinged plate or door which covers the battery, the battery being housed in a recess in the faceplate. Either type of battery compartment can be used, depending on which is best to achieve optimum fit and appearance. However when the concha flare is formed as a complete ring outwardly of and around the faceplate, battery removal may be made difficult. The removal operation can be facilitated by cutting a hole into the shell outwardly of the faceplate and below the concha flare rim, as indicated in dotted lines at 80 in FIG. 3. When this is done, then the battery compartment or door can be pivoted outwardly about hinge 38, and the battery can then be removed sideways through opening 80.

Alternatively, and preferably, the flare or protruding portion is contoured near to or down to the faceplate 34 (as shown e.g. in FIGS. 5 to 7 and 9 to 13) to allow space for easy battery handling. However enough of the flare should remain and project into the concha area to securely position the hearing aid in the ear canal, and also to function as an effective insertion and removal handle.

If desired, particularly if the concha flare extends well outwardly of the faceplate 34 of the hearing aid, the battery can be removed using a hooked tool to open the battery compartment 36. However when the flare is shaped so that it provides access to the battery compartment, as for example in the tragus area (e.g. FIG. 6), then access can be had to the battery compartment from this area, and special tools are not required either to open the battery compartment or to remove a battery from or insert it into the compartment.

Venting of the hearing aid 64 may be accomplished, as in the FIG. 2 hearing aid, by an opening 84 (FIG. 4) in the shell 66 at the inner end of the hearing aid 64. A tube 86 connected to the opening 84 and lies against the inner surface of the shell wall and extends to the faceplate 34. Other venting methods can also be used.

Typically, in prior art hearing aids (FIG. 2) where the vent tube 58 terminates in an opening 62 at the faceplate, there is a tendency to feedback. This occurs because sound radiated by the output transducer 48 into the volume 54 is conducted to some extent through the vent tube 58 and exits the tube 58 at the opening 62 which is located near the microphone opening 42.

According to a preferred feature of the embodiments described, the vent tube 86 is extended outwardly of the level of the faceplate 67, preferably to or near the end or rim of the flare 68, as shown at 88 in FIGS. 3 and 4. The greater physical separation between the vent opening 90 on or near the rim of the flare 68, and the microphone opening 42 in the faceplate 67, will provide a reduced tendency to feedback.

It will be appreciated that various changes may be made in the embodiments described, within the scope of the invention, and all are intended to be included within the scope of the appended claims.

I claim:

1. A hearing aid comprising:

(a) a shell adapted to be inserted into the ear canal of a user, said shell comprising a thin annular wall adapted to extend axially along said canal and defining a cavity within said shell, (b) sound receiving and amplification means in said cavity of said shell, including a microphone for receiving sound, an amplifier for producing an amplified sound signal, and an output transducer for producing amplified sound, (c) said shell having an inner end having an opening therein for delivery of amplified sound from said output transducer to the user's tympanic membrane, and having a faceplate located outwardly from said inner end and extending across said cavity, said sound receiving and amplification means being located between said faceplate and said inner ends, (d) said annular wall having an extended wall portion extending, as an integral continuation of said annular wall, outwardly axially along said canal past said faceplate, said extended wall portion also being a thin wall and being shaped to extend into and to lie at least in part against the surface of the concha area of the user's ear when the shell is inserted into the user's ear canal with the inner end of said shell adjacent the user's tympanic membrane and with said faceplate recessed within the user's ear canal, (e) said extended wall portion being shaped to anchor said shell and prevent it from moving into the ear canal and constituting a grip for insertion and removal of said hearing aid, and permitting access to said faceplate.

2. A hearing aid according to claim 1 and including a vent passage having a first end located adjacent said inner end of said shell and a second end located on said extended wall portion, said second end thereby being spaced outwardly of said faceplate, for venting the portion of the ear canal between the inner end of said shell and the user's eardrum.

3. A hearing aid according to claim 2 wherein said faceplate includes a microphone opening therein for admitting sound to said microphone, said second end of said vent passage being spaced outwardly of said microphone opening.

4. A hearing aid according to claim 3 wherein said vent passage comprises tube means extending from said inner end of said shell to said located on said extended wall portion.

5. A hearing aid according to claim 1, 2, 3 or 4 wherein said extended wall portion includes a hook-like bend therein to facilitate gripping.

6. A hearing aid according to claim 1, 2, 3 or 4 wherein said extended wall portion contains an aperture therein to facilitate gripping.

7. A hearing aid according to claim 1, 2 or 3 wherein said extended wall portion includes a hook-like bend therein, said extended wall portion also having an aperture therein, to facilitate gripping.

8. A hearing aid according to claim 1, 2, 3 or 4 wherein said faceplate includes a battery access door thereon for retaining a battery in said hearing aid, said extended wall portion extending substantially outwardly of said faceplate on one side of said faceplate and extending to a lesser extend outwardly of said faceplate on the other side of said faceplate, to facilitate insertion and removal of said battery.

9. A hearing aid according to claim 8 wherein said one side is opposite the tragus area of the user's ear and said other side is opposite said one side.

10. A hearing aid according to claim 8 wherein said one side is adjacent the anti-tragus area of the user's ear and said other side is opposite said one side.

11. A hearing aid according to claim 1, 2, 3 or 4 wherein said faceplate has an oval shape, having a pair of narrow ends and a pair of sides between said narrow ends, said sides being longer than said ends, said extended wall portion being extended outwardly adjacent said narrow ends to a greater extend than said extended wall portion extending outwardly adjacent said sides.

* * * * *